US006778157B2

(12) United States Patent
Aoki

(10) Patent No.: US 6,778,157 B2
(45) Date of Patent: Aug. 17, 2004

(54) IMAGE SIGNAL COMPENSATION CIRCUIT FOR LIQUID CRYSTAL DISPLAY, COMPENSATION METHOD THEREFOR, LIQUID CRYSTAL DISPLAY, AND ELECTRONIC APPARATUS

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 131 days.

(21) Appl. No.: 09/969,621

(22) Filed: Oct. 4, 2001

(65) Prior Publication Data

US 2002/0044126 A1 Apr. 18, 2002

(30) Foreign Application Priority Data

Oct. 4, 2000 (JP) ..... 2000-304981
Aug. 24, 2001 (JP) ..... 2001-254848

(51) Int. Cl.[7] ..... G09G 3/36
(52) U.S. Cl. ..... 345/87; 345/98; 345/100
(58) Field of Search ..... 345/87, 92, 213, 345/98–100, 211, 212; 358/451

(56) References Cited

U.S. PATENT DOCUMENTS 5,191,455 A * 3/1993 Hashimoto et al. ..... 359/85
5,229,860 A * 7/1993 Kido et al. ..... 348/625
5,418,626 A * 5/1995 Semasa ..... 358/451
6,329,975 B1 * 12/2001 Yamaguchi ..... 345/99
6,496,170 B1 * 12/2002 Yoshida et al. ..... 345/87
6,501,451 B1 * 12/2002 Sakashita ..... 345/87
6,531,996 B1 * 3/2003 Murade ..... 345/98
6,538,633 B1 * 3/2003 Ito ..... 345/99
6,556,180 B1 * 4/2003 Furuhashi et al. ..... 345/87
6,633,272 B1 * 10/2003 Kumagawa et al. ..... 345/98
6,661,400 B2 * 12/2003 Sakashita ..... 345/89

FOREIGN PATENT DOCUMENTS

| | | |
|---|---|---|
| JP | A 62-131233 | 6/1987 |
| JP | S63-071892 A | 4/1988 |
| JP | H02-184891 A | 7/1990 |
| JP | H02-217894 A | 8/1990 |
| JP | H03-198089 A | 8/1991 |
| JP | H05-307371 A | 11/1993 |
| JP | A 7-134282 | 5/1995 |
| JP | H07-134570 A | 5/1995 |
| JP | H07-253765 A | 10/1995 |
| JP | A 8-122744 | 5/1996 |
| JP | A 9-90906 | 4/1997 |
| JP | A 11-109927 | 4/1999 |
| JP | J0086636 | 4/2003 |

* cited by examiner

*Primary Examiner*—Richard Hjerpe
*Assistant Examiner*—Kimnhung Nguyen
(74) *Attorney, Agent, or Firm*—Oliff & Berridge, PLC

(57) ABSTRACT

An image signal compensation circuit includes a compensation-level output unit that outputs a compensation level Cmp which corresponds to the level of an uncompensated image signal; a selector that selects the compensation level Cmp for positive writing and a zero value for negative writing; and an adder that adds the selected value to the original image signal. The sum is subjected to polarity inversion every predetermined period on the basis of a predetermined constant potential and is applied to a pixel electrode. As a result, effective voltages applied to a liquid crystal capacitor for positive writing and negative writing are approximately the same, and application of a DC component to the liquid crystal capacitor is prevented.

22 Claims, 10 Drawing Sheets

[FIG. 1]
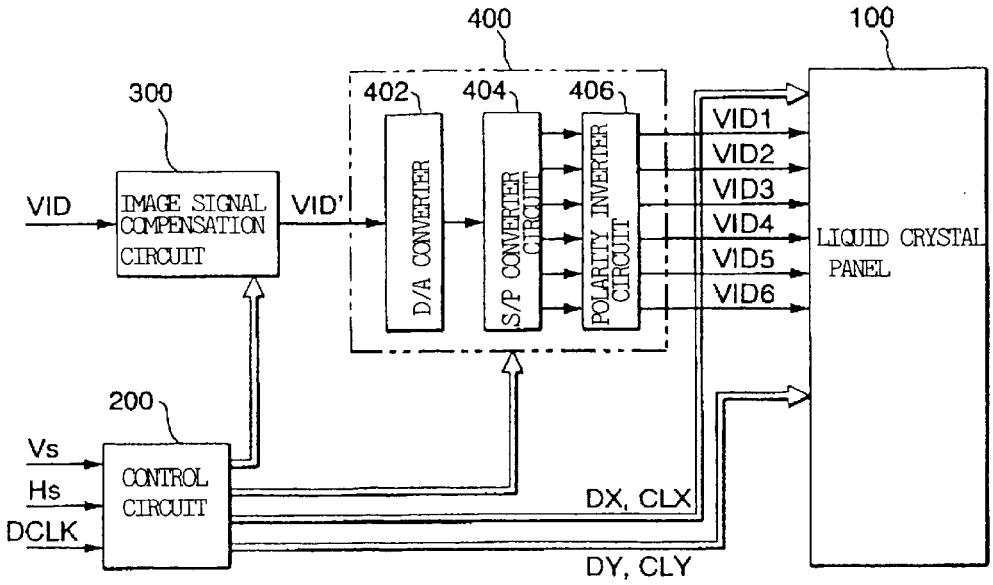

[FIG. 2]
(a)
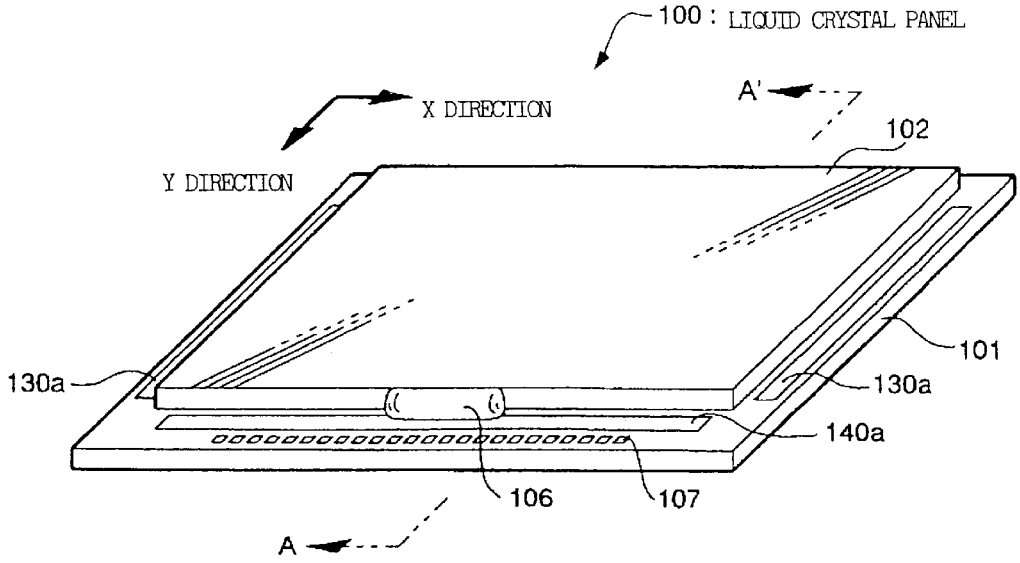
(b)
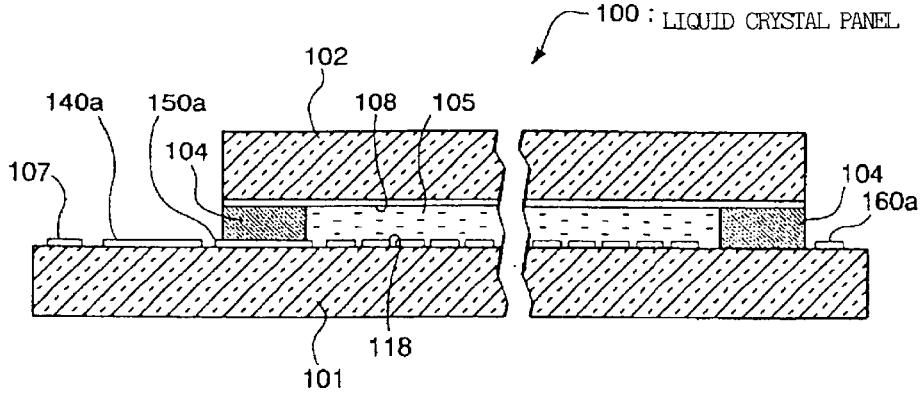

[FIG. 3]
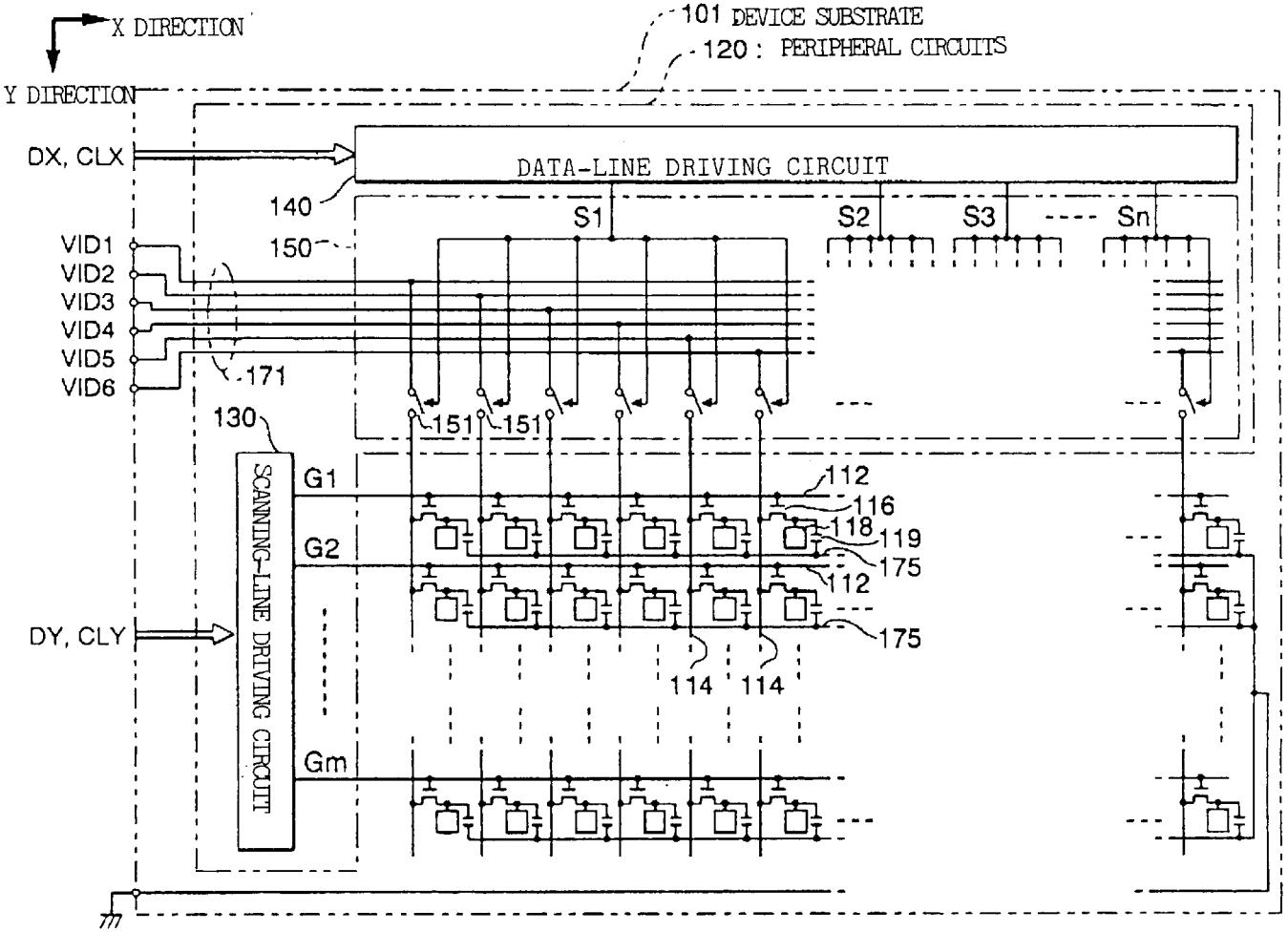

[FIG. 4]
(a)
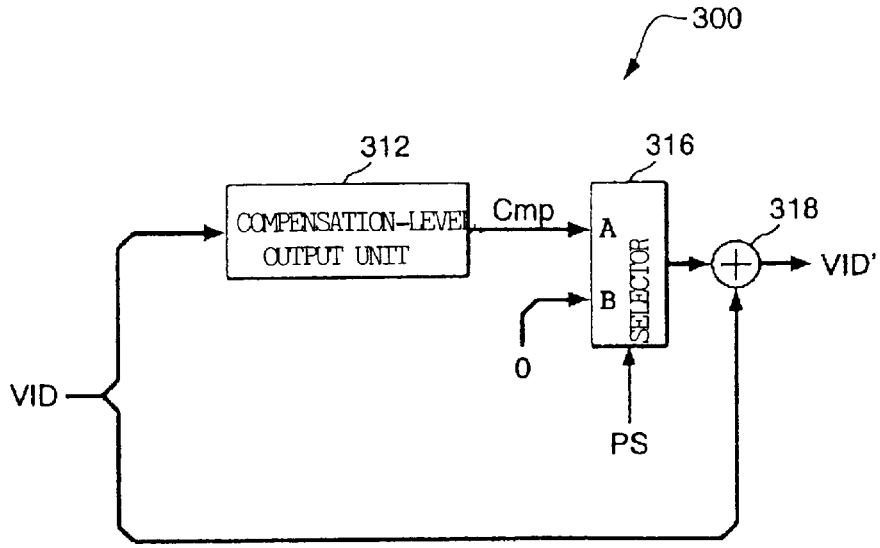
(b)
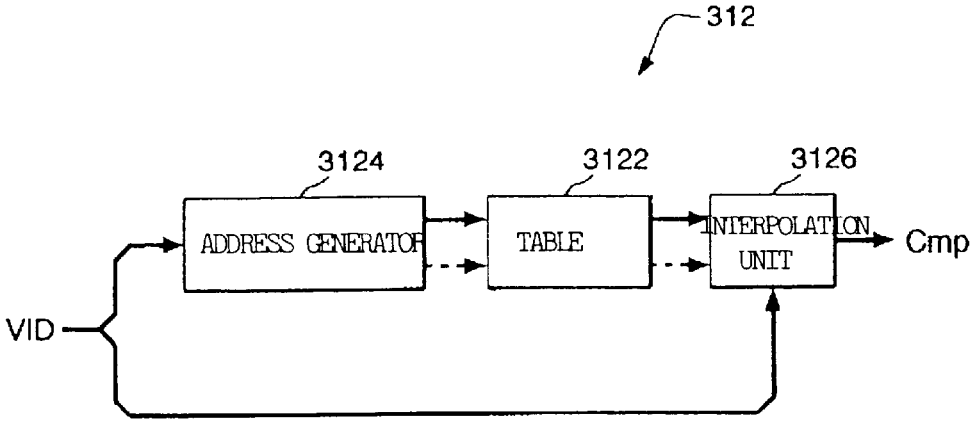

[FIG. 5]
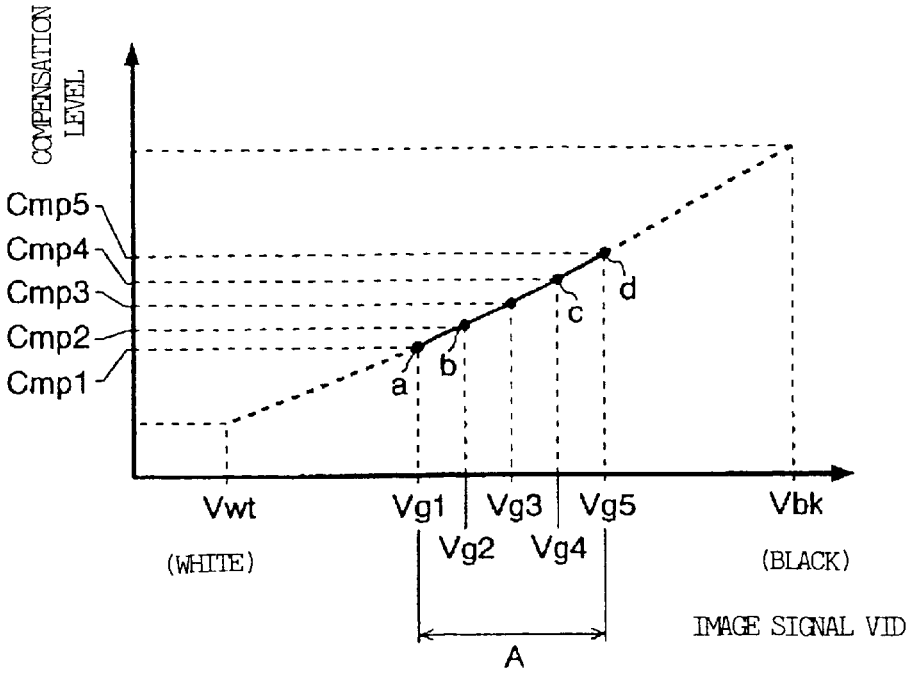

[FIG. 6]
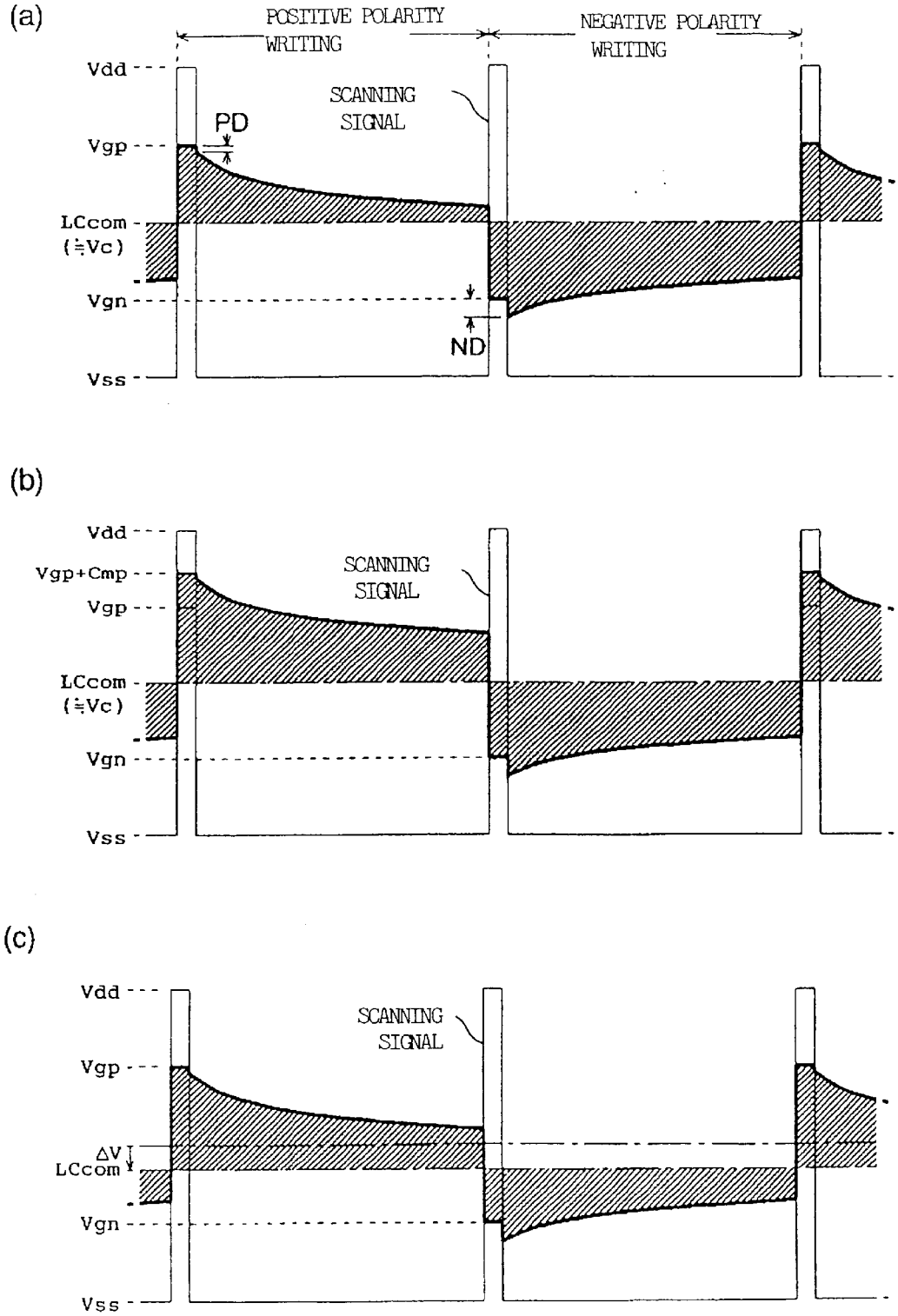

[FIG. 7]
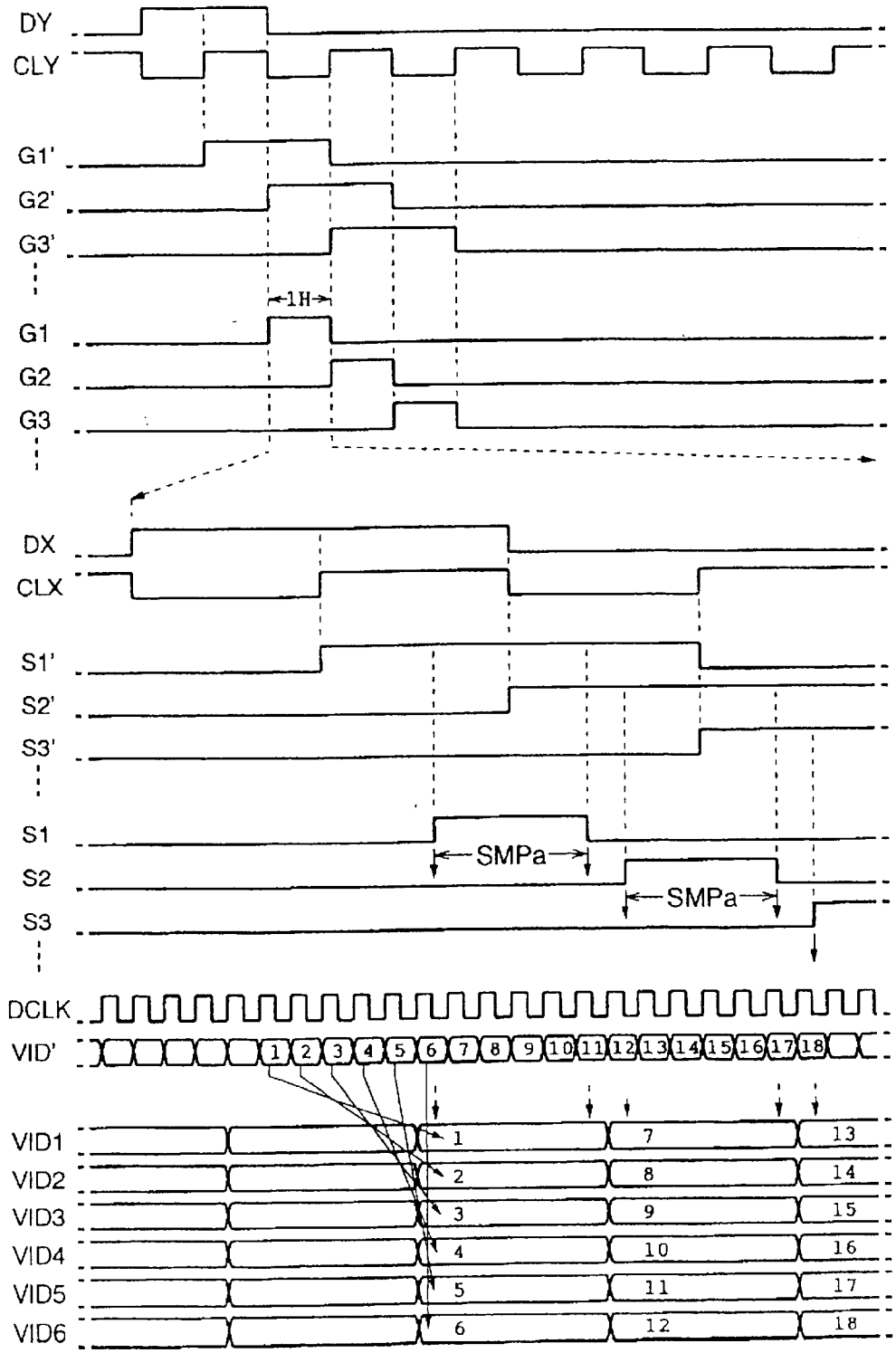

[FIG. 8]
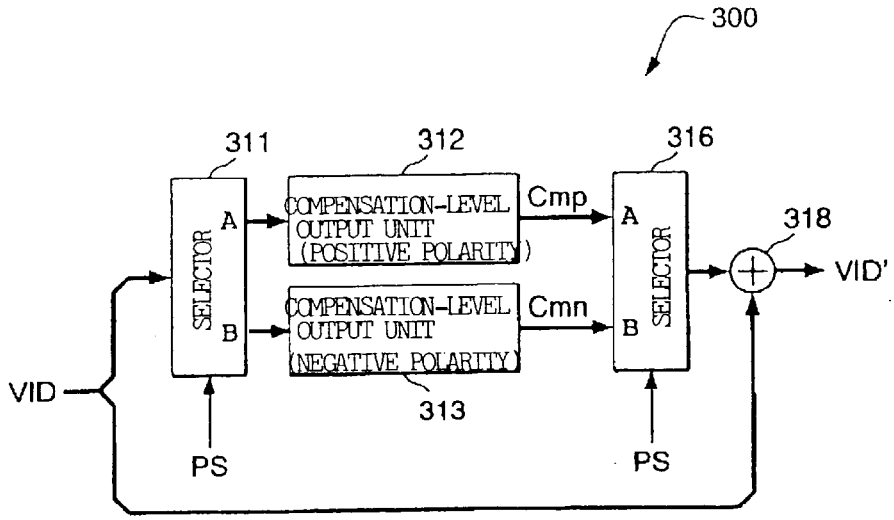
[FIG.9]
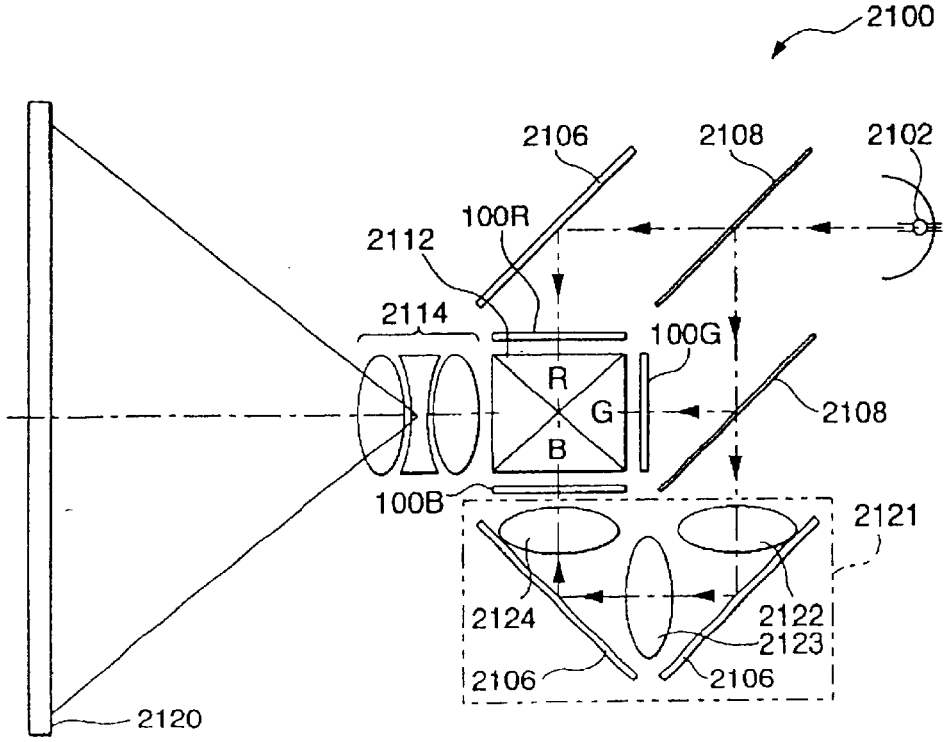

[FIG. 10]
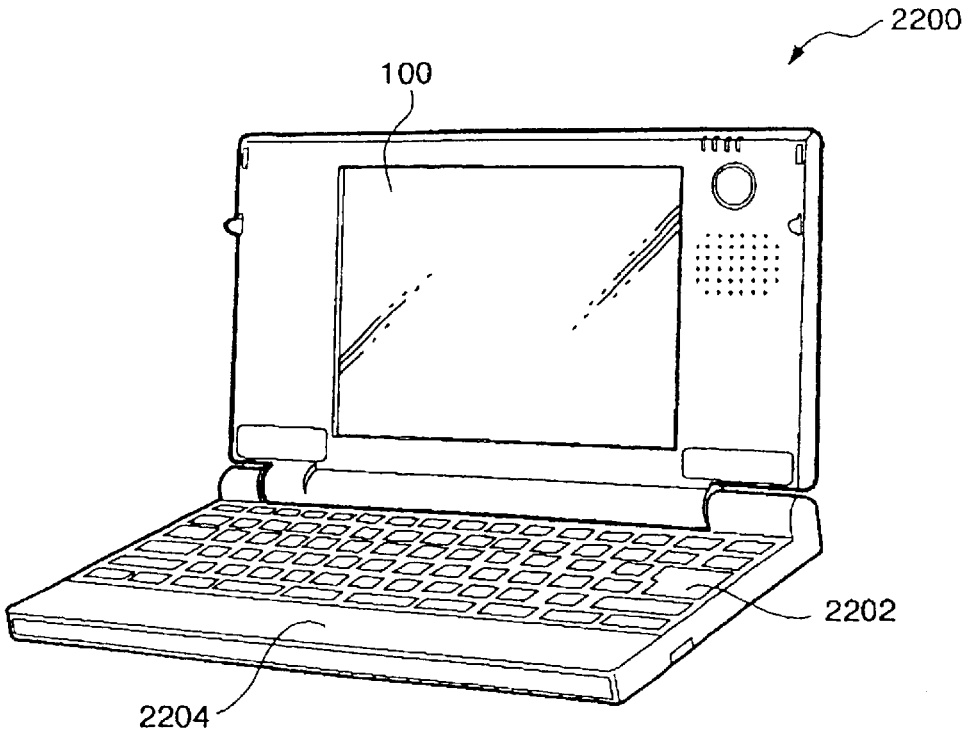

[FIG. 11]
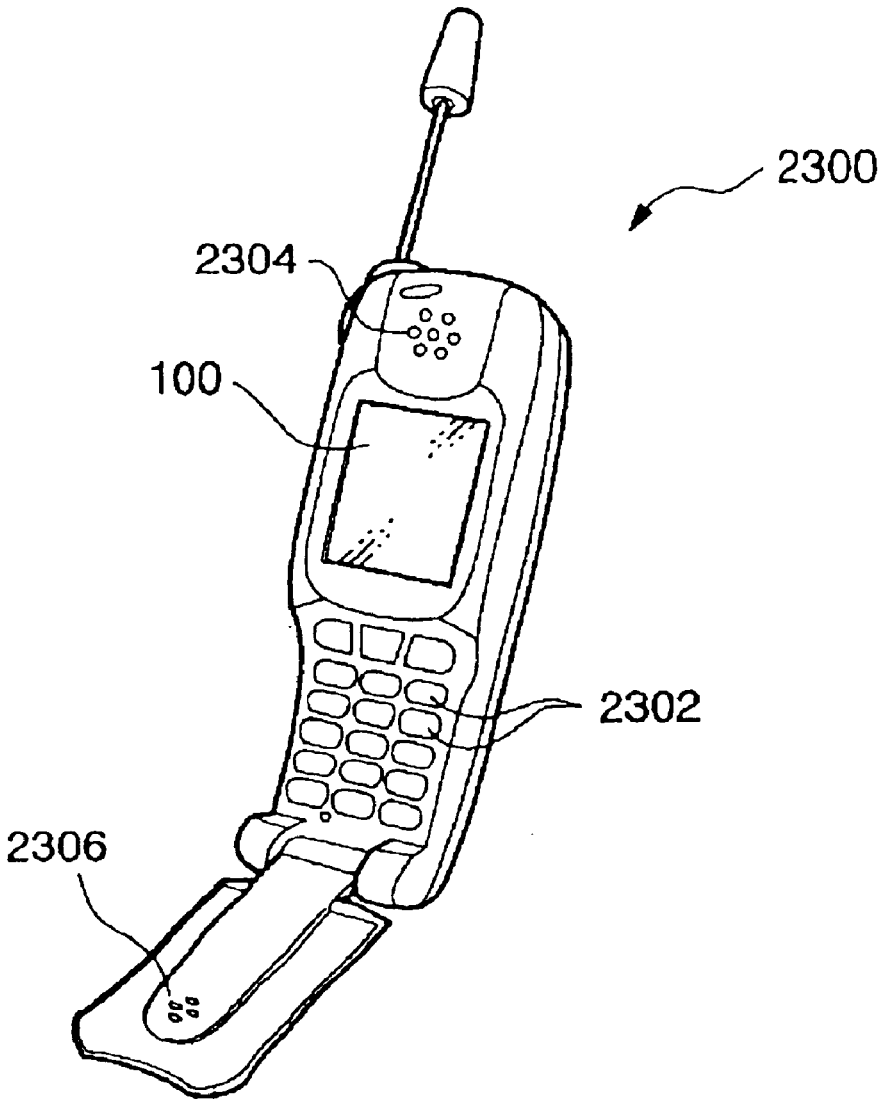

IMAGE SIGNAL COMPENSATION CIRCUIT FOR LIQUID CRYSTAL DISPLAY, COMPENSATION METHOD THEREFOR, LIQUID CRYSTAL DISPLAY, AND ELECTRONIC APPARATUS

BACKGROUND OF THE INVENTION

1. Field of the Invention

The present invention relates to liquid crystal displays, image signal compensation circuits, compensation methods therefor, and electronic apparatuses in which what is referred to as "burn-in" is prevented.

2. Description of Related Art

Typically, liquid crystal panels, which perform predetermined display using liquid crystal, have a structure in which the liquid crystal is held between a pair of substrates. These liquid crystal panels can be classified according to their driving systems. For example, an active-matrix-type, in which pixel electrodes are driven by switching elements has on one substrate of the pair of substrates, a plurality of scanning lines and a plurality of data lines which are formed so as to intersect with each other, while insulation is maintained therebetween. A thin film transistor ("TFT"), which is an example of a switching element and a pixel electrode form a pair at each intersection. Around a region (display region) in which pixel electrodes are formed, peripheral circuits for driving scanning lines and data lines are provided. On the other substrate, a transparent counter electrode (common electrode) opposed to the pixel electrodes is provided, and the counter electrode is maintained at a predetermined potential. Furthermore, disposed on the opposing surfaces of the two substrates, are alignment layers, rubbed so that a long-axis direction of liquid crystal molecules is continuously twisted between the two substrate at, for example, approximately 90 degrees. On the back surface of each of the two substrates, is disposed a polarizer in accordance with the alignment direction.

Concerning the switching element provided at the intersection of the scanning line and the data line, when a scanning signal (gate signal) applied to the corresponding scanning line becomes an ON-state potential, a connection between the source connected to the data line and the drain connected to the pixel electrode is established. Thus, an image signal supplied to the data line is applied to the pixel electrode, and the potential difference between the potential of the counter electrode and the potential of the image signal is applied to a liquid crystal capacitor formed of the pixel electrode, the counter electrode, and the liquid crystal therebetween. If the switching is turned off, the liquid crystal capacitor maintains the applied potential difference in accordance with the characteristics of the liquid crystal capacitor and a storage capacitor.

If the effective voltage applied across the two electrodes is zero, light which passes between the pixel electrode and the counter electrode is rotated by approximately 90 degrees along the twisting of the liquid crystal molecules. As the effective voltage increases, the liquid crystal molecules tilt toward the electrical field direction, resulting in loss of rotatory polarization. For example, in a transmissive-type liquid crystal display, when polarizers in which polarizing axes are orthogonal to each other in accordance with the alignment direction are formed at the light-incident side and the back side (in normally white mode), and when the effective voltage applied across the two electrodes is zero, light passes between the two electrodes, thereby displaying white (transmissivity becomes high). As the effective voltage applied across the two electrodes increases, light is blocked, and eventually black is displayed (transmissivity becomes low). By supplying scanning signals to the scanning lines and image signals to the data lines with an appropriate timing, the effective voltage in accordance with the gray level can be applied to each liquid crystal capacitor. As a result, gray-scale display in which the gray-level differs for each pixel can be performed.

In principle, a liquid crystal display employs an AC driving system for driving the liquid crystal capacitor in order to prevent deterioration of the liquid crystal, which is caused by application of a direct current (DC) component. An image signal applied to the pixel electrode via the data line is alternately inverted every predetermined period between the positive polarity and the negative polarity on the basis of a predetermined constant potential Vc.

SUMMARY OF THE INVENTION

In a switching element, such as a TFT, a phenomenon which is referred to as "a push-down phenomenon" occurs. Specifically, as shown in FIG. 6(*a*), the push-down phenomenon means that, when a scanning signal (gate signal) changes from an ON-state potential Vdd to an OFF-state potential Vss, the potential displacement reduces the potential of the drain (pixel electrode) via a parasitic capacitance between the gate and the drain.

The potential displacement caused by the push-down phenomenon increases as a write potential, namely, a source potential, decreases. When voltages Vgp and Vgn, which correspond to the same gray level, are written towards the positive polarity side and the negative polarity side, potential displacements PD and ND caused by the push-down phenomenon become larger at the negative polarity side.

When light passes between the two substrates, part of the light enters the TFT. Even when the scanning signal becomes an OFF-state potential Vss, thereby entering the off period (holding period), a small leakage current (light current) flows through the TFT. The degree of leakage may differ between the positive polarity writing and the negative polarity writing.

Accordingly, the effective voltage actually applied to the liquid crystal capacitor (which corresponds to portions indicated by oblique lines in FIG. 6(*a*)) may differ between the positive polarity writing and the negative polarity writing, and hence a DC component is applied to the liquid crystal. When the DC component is applied to the liquid crystal, the liquid crystal deteriorates due to dielectric polarization or the like. As a result, "burn-in" occurs.

In view of the foregoing circumstances, it is an object of the present invention to provide a liquid crystal display, an image signal compensation circuit, a compensation method, and an electronic apparatus, in which "burn-in" is suppressed.

In order to achieve the foregoing objects, a first aspect of the invention is a liquid crystal display image signal compensation circuit having a plurality of scanning lines, a plurality of data lines, and pixels which correspond to intersections between the scanning lines and the data lines. The pixels comprised of a pixel electrode and opposing electrode between which liquid crystal is sandwiched to form a liquid crystal capacitor, and a switching element which establishes a connection between the corresponding data line and the pixel electrode in accordance with the level of a signal supplied to the corresponding scanning line. The liquid crystal display inverts the polarity of an image signal, which is in synchronization with horizontal scanning and vertical scanning, every predetermined period on the basis of a predetermined constant potential, and supplies the image signal to the pixel electrode through the data line. The image signal compensation circuit that compensates for the image signal for the liquid crystal display includes a compensation-level output unit to output a compensation level which corresponds to the level of the uncompensated image signal; and an adder that adds the compensation level to the uncompensated image signal and outputs the sum as the compensated image signal.

According to this arrangement, the compensation-level output unit outputs a value in consideration of the effects of push-down and light leakage as a compensation level with respect to an image signal at a particular level. Thus, the effective voltage actually applied to the liquid crystal capacitor when a positive-polarized image signal is applied to the pixel electrode, and the effective voltage actually applied to the liquid crystal capacitor when a negative-polarized image signal is applied are approximately the same. As a result, application of a DC component to the liquid crystal capacitor is prevented, thereby suppressing deterioration of the display quality due to burn-in or the like.

According to the present invention, no problem occurs as long as the effective voltage at one polarity eventually becomes equal to the effective voltage at the other polarity. It is thus unnecessary to output compensation levels at both polarities, namely, the positive polarity and the negative polarity. According to the first aspect of the invention, it is preferable that the compensation-level output unit output the compensation level which corresponds to only the level of the image signal at one polarity, and preferably the compensation-level output unit outputs approximately zero as the compensation level which corresponds to the level of the image signal at the other polarity. According to this arrangement, it is only necessary to output a compensation level which corresponds to only one polarity. Thus, the structure is simplified.

In order to simplify the structure, it is preferable that the compensation-level output unit include a table in which the relationship between the level of the uncompensated image signal and the compensation level is stored beforehand.

In this arrangement, preferably the table stores the relationship at two or more points. When the level of the uncompensated image signal is within the range of the stored relationship, it is preferable that the table interpolate and output the compensation level which corresponds to the level of the uncompensated image signal based on the stored relationship. According to this arrangement, it is unnecessary to store compensation levels for image signals at all possible levels, thereby reducing the storage capacity required for the table.

In order to reduce the storage capacity, when the level of the uncompensated image signal is outside the range of the stored relationship, it is preferable that the table estimate and output the compensation level which corresponds to the level of the uncompensated image signal based on the stored relationship. Concerning estimation modes, various modes can be employed, such as a mode of obtaining a compensation level by extrapolation using the correlated points stored in the table, a mode of obtaining a compensation level using an extension of the straight line between the correlated points, and a mode of multiplying the compensation level at the nearest point by a coefficient in accordance with the distance from the nearest point.

In order to achieve the foregoing objects, a second aspect of the invention is an image signal compensation method for a liquid crystal display. The liquid crystal display includes pixels corresponding to intersections between a plurality of scanning lines and a plurality of data lines. The pixels comprised of a pixel electrode and opposing electrode between which liquid crystal is sandwiched to form a liquid crystal capacitor, and a switching element which establishes a connection between the corresponding data line and the pixel electrode in accordance with the level of a signal supplied to the corresponding scanning line. The liquid crystal display inverts the polarity of an image signal, which is in synchronization with horizontal scanning and vertical scanning, every predetermined period on the basis of a predetermined constant potential, and supplies the image signal to the pixel electrode through the data line. The image signal compensation method for compensating for the image signal for the liquid crystal display includes the steps of outputting a compensation level which corresponds to the level of the uncompensated image signal; and adding the compensation level to the uncompensated image signal and outputting the sum as the compensated image signal.

Since the second aspect of the invention is a method corresponding to the first aspect of the invention, in a similar manner, application of a DC component to the liquid crystal capacitor is prevented, thereby suppressing deterioration of the display quality due to burn-in.

According to the liquid crystal display, in a region in which pixels are at intermediate gray levels (gray), a small difference in the effective voltages applied to the liquid crystal capacitor causes a great change in the gray level. Conversely, when an image signal, which corresponds to gray, is alternately applied to the pixel electrode at the positive polarity and the negative polarity so that the gray levels are adjusted to be approximately the same, the effective voltages applied to the liquid crystal capacitor at both polarities can be equalized. According to the second aspect of the invention, it is preferable that a compensation level corresponding to an image signal at a particular level be a value adjusted so that a gray level difference between a case in which the compensation level is added to the original image signal, and the sum is applied to the pixel electrode, and a case in which an image signal at the other polarity is applied to the pixel electrode becomes small. It thus becomes possible to set a compensation level without taking into consideration the effects of push-down and light leakage.

In order to achieve the foregoing objects, a third aspect of the invention is a liquid crystal display including a plurality of scanning lines; a plurality of data lines; pixels corresponding to intersections between the plurality of scanning lines and the plurality of data lines. The pixels comprised of a pixel electrode and opposing electrode between which liquid crystal is sandwiched to form a liquid crystal capacitor, and a switching element which establishes a connection between the corresponding data line and the pixel electrode in accordance with the level of a signal supplied to the scanning line. An image signal compensation circuit is also provided that compensates for an image signal which is in synchronization with horizontal scanning and vertical scanning before the polarity of the image signal is inverted every predetermined period on the basis of a predetermined constant potential and the image signal is supplied to the pixel electrode through the data line. The image signal compensation circuit includes a compensation-level output unit that outputs a compensation level which corresponds to the level of the uncompensated image signal, and an adder that adds the compensation level to the uncompensated image signal and outputs the sum as the compensated image signal.

According to the third aspect of the invention, as in the first aspect of the invention, application of a DC component to the liquid crystal capacitor is prevented, thereby suppressing deterioration of the display quality due to burn-in.

An electronic apparatus according to the present invention includes the above-described liquid crystal display as a display device. Thus, burn-in is prevented, and high-quality, reliable display can be performed.

BRIEF DESCRIPTION OF THE DRAWINGS

FIG. 1 is a schematic showing the overall structure of a liquid crystal display according to an embodiment of the present invention;

FIG. 2(*a*) is a perspective view of the exterior structure of a liquid crystal panel of the liquid crystal display; and FIG. 2(*b*) is a sectional view taken along plane A–A' of FIG. 2(*a*);

FIG. 3 is a schematic showing the electrical structure of a device substrate of the liquid crystal panel;

FIG. 4(*a*) is a schematic showing an image signal compensation circuit of the liquid crystal display; and FIG. 4(*b*) is a schematic showing the structure of a compensation-level output unit of the image signal compensation circuit;

FIG. 5 is a graph illustrating the contents recorded in a compensation table of the image signal compensation circuit;

FIG. 6(*a*) is a voltage waveform diagram illustrating a state where a DC component is applied to a liquid crystal capacitor; FIG. 6(*b*) is a voltage waveform diagram which illustrates the prevention of burn-in in this embodiment; and FIG. 6(*c*) is a voltage waveform diagram which illustrates a state where the effective voltage at the positive polarity side and that at the negative polarity side are balanced by adjusting the potential of a counter electrode;

FIG. 7 is a timing chart for illustrating the operation of the liquid crystal display of the embodiment;

FIG. 8 is a schematic showing a modification of the image signal compensation circuit of the embodiment;

FIG. 9 is a schematic of the structure of a projector, which is an example of an electronic apparatus to which the liquid crystal display of the embodiment is applied;

FIG. 10 is a perspective view of the structure of a personal computer, which is an example of an electronic apparatus to which the liquid crystal display of the embodiment is applied; and FIG. 11 is a perspective view of the structure of a cellular phone, which is an example of an electronic apparatus to which the liquid crystal display of the embodiment is applied.

DETAILED DESCRIPTION OF PREFERRED EMBODIMENTS

A liquid crystal display according to an embodiment of the present invention is described below.

Overall Structure

The electrical structure of the liquid crystal display is described. FIG. 1 is a schematic showing the electrical structure of the liquid crystal display. As shown in FIG. 1, the liquid crystal display includes a liquid crystal panel 100, a control circuit 200, an image signal compensation circuit 300, and a processing circuit 400. From among these components, the control circuit 200 generates a timing signal and a clock signal that controls each section in accordance with a vertical scanning signal Vs, a horizontal scanning signal Hs, and a dot clock signal DCLK, which are all supplied from a high-level device.

The image signal compensation circuit 300 generates a compensation signal from a digital image signal VID, which is supplied in synchronization with the vertical scanning signal Vs, the horizontal scanning signal Hs, and the dot clock signal DCLK (in accordance with the vertical scanning and the horizontal scanning), and adds the compensation signal to the original image signal VID, thereby outputting a compensated image signal VID'. The image signal compensation circuit 300 will be described in detail below.

The processing circuit 400 includes a D/A converter 402, an S/P converter circuit 404, and a polarity inverter circuit 406. The processing circuit 400 processes the compensated image signal VID' from the image signal compensation circuit 300 into a signal suitable for the liquid crystal panel 100. From among these components, the D/A converter 402 converts the compensated digital image signal VID' into an analog image signal. In response to the analog image signal, the S/P converter circuit 404 divides the analog image signal into N lines (N=6 in FIG. 1). Also, the S/P converter circuit 404 performs time-base N-fold expansion of the signals (serial-parallel conversion) and outputs the signals.

From among the image signals which have undergone serial-parallel conversion, the polarity inverter circuit 406 inverts the polarity of each signal that is required to be subjected to polarity inversion and supplies the signals as image signals VID1 to VID6 to the liquid crystal panel 100. The polarity inversion is implemented by alternately inverting the voltage level between the positive polarity and the negative polarity on the basis of a predetermined constant potential Vc (which is a central potential of the amplitude of the image signal, and which is generally about the same as a potential LCcom of the counter electrode).

The determination as to whether or not the voltage level is inverted is made based on whether or not a system that applies data signals employs (1) polarity inversion in scanning line units, (2) polarity inversion in data signal line units, or (3) polarity inversion in pixel units. The inversion period is set to a horizontal scanning period or a dot clock period. In this embodiment, in order to simplify the description, a case in which the polarity inversion is performed in scanning line units (1) is described. However, the present invention is not limited to this case.

Although the image signals VID1 to VID6 are simultaneously supplied to the liquid crystal panel 100 in this embodiment, timings to supply the image signals VID1 to VID6 can be sequentially shifted in synchronization with a dot clock. In such a case, a sampling circuit (described below) sequentially samples the image signals for N lines.

In this example, the signals are converted to analog signals at the input side of the processing circuit 400. However, the signals can be converted to analog signals subsequent to serial-parallel conversion or polarity inversion.

Structure of Liquid Crystal Panel

The structure of the liquid crystal panel 100 will now be described.

FIG. 2(*a*) is a perspective view of the structure of the liquid crystal panel 100.

FIG. 2(*b*) is a sectional view taken along plane A–A' of FIG. 2(*a*).

As shown in FIGS. 2(*a*) and 2(*b*), the liquid crystal panel 100 is constructed from a device substrate 101, on which pixel electrodes 118 and the like are formed, and an opposing substrate 102 on which a counter electrode 108 is formed, are aligned and bonded together such that a predetermined gap is maintained therebetween, by a sealing material 104 which includes a spacer (not shown), so that the surfaces of the two substrates, having electrodes formed thereon, are opposed to each other. The gap is filled with, for example, TN (Twisted Nematic) type liquid crystal 105.

In this embodiment, glass, semiconductor, or quartz is used to form the device substrate 101, but use an opaque substrate may be used instead. However, if an opaque substrate is used as the device substrate 101, the liquid crystal panel 100 is not used as a transmissive type and instead is used as a reflective type. The sealing material 104 is formed along the periphery of the opposing substrate 102 but with an opening in a portion of the sealing material 104 through which liquid crystal 105 is injected. After the liquid crystal 105 is injected through the opening, the opening is sealed by a sealant 106.

On the opposing surface of the device substrate 101, a data-line driving circuit 140 is formed on one side, in a region 140*a* outside of the sealing material 104. In a region 150*a* inside of the sealing section 104, a sampling circuit 150 is formed. On the perimeter at one side, a plurality of mounting terminals 107 is formed, and various signals can be input from the control circuit 200 and the processing circuit 400.

In two side regions 130*a* which are adjacent to this one side, scanning-line driving circuits 130 are formed, and the scanning lines are driven from both sides. If delays in scanning signals supplied to the scanning lines do not matter, then only one side need be equipped with a scanning-line driving circuit 130 can be formed at one side. In a region 160*a* at the remaining side, wires (not shown) shared by the two scanning-line driving circuits 130 are formed.

Concerning the counter electrode 108 on the opposing substrate 102, electrical conduction is established with the mounting terminals 107 formed on the device substrate 101 by conductive material, such as silver paste which is provided in at least one of the four corners at which the substrates are bonded together. As a result, the counter electrode 108 is maintained at the constant potential LCcom.

If necessary, colored layers (color filters) (not shown) are provided in a region on the opposing substrate 102 opposed to the pixel electrodes 118. If the liquid crystal panel 100 is applied to modulate light rays, such as in a projector (described below), it is unnecessary to provide colored layers on the opposing substrate 102. Regardless of whether or not the colored layers are provided, a light-blocking film (not shown) is provided in a portion other than the region opposed to the pixel electrode 118 in order to prevent reduction of the contrast ratio due to light leakage.

On the surfaces of the device substrate 101 and the opposing substrate 102, which are opposed to each other, alignment layers are formed, which are rubbed so that the long-axis direction of the molecules of the liquid crystal 105 is continuously twisted by approximately 90 degrees between the substrates. On the back surfaces of the device substrate 101 and the opposing substrate 102, polarizers in accordance with the alignment directions are formed. Since the alignment layers and the polarizers are not directly related to the present case, drawings thereof are omitted. The counter electrode 108, the pixel electrodes 118, the mounting terminals 107 shown in FIG. 2(*b*) have a thickness. However, this depiction is provided to illustrate the relative positions. In reality, the thickness of each of these components is so small that it can be ignored with respect to the thickness of each of the substrates.

Device Substrate

The electrical structure of the device substrate 101 of the liquid crystal panel 100 will now be described. FIG. 3 is a schematic showing the structure of the device substrate 101.

As shown in FIG. 3, in a display region of the device substrate 101, a plurality of scanning lines 112, which are parallel to one another, are formed in the row (X) direction, and a plurality of data lines 114, which are parallel to one another, are formed in the column (Y) direction. At the intersections of the scanning lines 112 and the data lines 114, the gates of TFTs 116, which are switching elements that control the pixels, are connected to the corresponding scanning lines 112; the sources of the TFTs 116 are connected to the corresponding data lines 114; and the drains of the TFTs 116 are connected to the rectangular, transparent pixel electrodes 118.

As described above, in the liquid crystal panel 100, the liquid crystal 105 is held between the electrode-forming surfaces of the device substrate 101 and the opposing substrate 102 on which electrodes have been formed. The liquid crystal capacitor of each pixel is formed of the pixel electrode 118, the counter electrode 108, and the interstitial liquid crystal 105 between the two electrodes. In order to simplify the following description, the total number of scanning lines 112 is "m", and the total number of data lines 114 is "6n" (where m and n are integers). Pixels are aligned in the form of an m×6n matrix corresponding to the intersections of the scanning lines 112 and the data lines 114.

In the display region formed of the pixels aligned in the matrix form, a storage capacitor 119 that prevents leakage from the liquid crystal capacitor is provided for each pixel. One end of the storage capacitor 119 is connected to the pixel electrode 118 (drain of the TFT 116), and the other end of the storage capacitor 119 is commonly connected by a capacitance line 175. In this embodiment, the capacitance line 175 is commonly grounded via the mounting terminal 107 at a predetermined potential (potential LCcom, a higher potential side or a lower potential side of the power supply of the driving circuits, or the like).

In a non-display region of the device substrate 101, peripheral circuits 120 are formed. The peripheral circuits 120 are conceived as circuits which include the scanning-line driving circuits 130, the data-line driving circuit 140, the sampling circuit 150, and a check circuit that checks the liquid crystal panel 100 for failures after fabrication. Since the check circuit is not directly related to the present invention, a description thereof is omitted.

The components of the peripheral circuits 120 are formed by a manufacturing process which is common with that of the TFTs 116 that drive the pixels. In this manner, the peripheral circuits 120 are integrated in the device substrate 101, and the components of the peripheral circuits 120 are formed by the common process. This has advantages in terms of miniaturization and cost reduction over an external type in which the peripheral circuits 120 are formed on a different substrate and are externally attached.

From among the peripheral circuits 120, the scanning-line driving circuit 130 outputs, within a vertical scanning period, scanning signals G1, G2, . . . , Gm, which sequentially become the ON-state potential every horizontal scanning period 1H. Since details regarding the scanning-line driving circuit 130 are not directly related to the present invention, a drawing of the scanning-line driving circuit 130 is omitted. The scanning-line driving circuit 130 includes a shift register and a plurality of AND circuits. As shown in FIG. 7, the shift register sequentially shifts a transfer start pulse DY, which is supplied at the beginning of vertical scanning every time the level of a clock signal CLY changes (both rising and falling), and outputs it as signals G1', G2', G3', . . . , Gm'. Each AND circuit obtains the AND signal of the adjacent signals from among the signals G1', G2', G3', . . . , Gm', and outputs the obtained AND as scanning signals G1, G2, G3, . . . , Gm.

The data-line driving circuit 140 outputs sampling signals S1, S2, . . . , Sn which sequentially become an ON-state potential within a horizontal scanning period 1H. Since details regarding the data-line driving circuit 140 are not related to the present invention, a drawing of the data-line driving circuit 140 is omitted. The data-line driving circuit 140 includes a shift register and a plurality of AND circuits. As shown in FIG. 7, the shift register sequentially shifts a transfer start pulse DX which is supplied at the beginning of a horizontal scanning period 1H every time the level of a clock signal CLX changes, and outputs it as signals S1', S2', S3', . . . , Sn'. Each AND circuit narrows the pulse duration of each of the signals S1', S2', S3', . . . , Sn' to a period SMPa so that the adjacent signals do not overlap each other, and outputs sampling signals S1, S2, S3, . . . , Sn.

The sampling circuit 150 samples image signals VID1 to VID6 which are supplied via six image signal lines 171 in accordance with the sampling signals S1, S2, S3, . . . , Sn for the corresponding data lines 114. The sampling circuit 150 includes sampling switches 151 which are provided for the respective data lines 114.

The data lines 114 are grouped in blocks of six lines. In FIG. 3, from among six data lines 114, which belong to the i-th block (i=1, 2, . . . , n) from the left, the sampling switch 151 connected to one end of the leftmost data line 114 samples the image signal VID1 which is supplied via the image signal line 171 in a period in which a sampling signal Si becomes the ON-state voltage, and supplies the sampled image signal VID1 to the data line 114. From among the six data lines 114 which belong to the i-th block, the sampling switch 151 connected to one end of the second data line 114 samples the image signal VID2 in a period in which the sampling signal Si becomes the ON-state potential, and supplies the sampled image signal VID2 to the data line 114. In a similar manner, each sampling switch 151 connected to one end of each of the third, fourth, fifth, and sixth data lines 114 from among the six data lines 114, which belong to the i-th block, samples the corresponding image signal VID3, VID4, VID5, and VID6 in a period in which the sampling signal Si becomes the ON-state potential, and each sampling switch 151 supplies the sampled image signal to the corresponding data line 114.

In this embodiment, N-channel TFTs are used to form the sampling switches 151. When the sampling signals S1, S2, . . . , Sn become the H level, the corresponding sampling switches 151 are turned on. Alternatively, P-channel TFTs can be used to form the sampling switches 151. Instead, complementary TFTs can be used to form the sampling switches 151.

Although FIG. 3 shows only one scanning-line driving circuit 130 at one side of the scanning lines 112, this is only intended to simplify the description of the electrical structure. In reality, as shown in FIG. 2, two scanning-line driving circuits 130 are provided, one on each side of the scanning lines 112.

Details of Image Signal Compensation Circuit

Details of the image signal compensation circuit 300 will now be described. FIG. 4(*a*) is a schematic showing the structure of the image signal compensation circuit 300.

As shown in FIG. 4(*a*), the image signal compensation circuit 300 includes a compensation-level output unit 312, a selector 316, and an adder 318. From among these components, the compensation-level output unit 312 outputs a compensation level Cmp, with a characteristic shown in FIG. 5, in response to the image signal VID, which is a digital signal before being subjected to the polarity inversion by the polarity inverter circuit 406 (see FIG. 1), and which has information indicating the gray level of a pixel. The detailed structure of the compensation-level output unit 312 is described below.

Specifically, as shown in FIG. 4(*b*), the compensation-level output unit 312 includes a table 3122, an address generator 3124, and an interpolation unit 3126. From among these components, the table 3122 stores beforehand compensation levels Cmp1 to Cmp5, which correspond to five gray levels Vg1 to Vg5 shown in FIG. 5, respectively, and outputs a compensation level designated by an address.

The address generator 3124 determines the level of the image signal VID. If the determined level is any one of the five gray levels Vg1 to Vg5, the address generator 3124 outputs an address for reading the corresponding compensation level from the table 3122. If the determined level is not one of the five gray levels, the address generator 3124 classifies the results into the following cases, and outputs an address for reading the compensation level from the table 3122.

In a first case in which the level of the image signal VID is towards the white end compared with the gray level Vg1, the address generator 3124 outputs an address that reads the compensation level Cmp1 which corresponds to the gray level Vg1. A second aspect will now be described in which the level of the image signal VID is within a range A of the gray levels Vg1 to Vg5, and in which the level does not correspond to any of the five levels. In this case, the address generator 3124 outputs addresses for reading compensation levels which correspond to the gray levels, from among the five gray levels Vg1 to Vg5, which are positioned before and after the image signal VID. For example, if the level of the image signal VID is towards the black end compared with the gray level Vg2, and towards the white end compared with the gray level Vg3, the address generator 3124 outputs addresses that read a compensation level Cmp2, which corresponds to the gray level Vg2, and a compensation level Cmp3, which corresponds to the gray level Vg3. In a third aspect, in which the level of the image signal VID is towards the black end compared with the gray level Vg5, the address generator 3124 outputs an address that reads the compensation level Cmp5, which corresponds to the gray level Vg5.

If the level of the image signal VID is any one of the five gray levels Vg1 to Vg5, the interpolation unit 3126 outputs the compensation level read from the table 3122 as the compensation level Cmp. If the level of the image signal VID is not one of the five gray levels, the interpolation unit 3126 classifies the results into the following cases and interpolates the compensation level read from the table 3122.

In the above-described first aspect, the interpolation unit 3126 multiples (Cmp2−Cmp1)/(Vg2−Vg1), which indicates the slope in FIG. 5, by the difference which is obtained by subtracting the level of the image signal VID from the gray level Vg1, and the interpolation unit 3126 subtracts the product from the read compensation level Cmp1, and outputs the difference as the compensation level Cmp. In other words, in the above-described first case, the interpolation unit 3126 computes the compensation level Cmp which corresponds to the image signal VID as a point on an extension of the straight line between point a and point b towards the white end in FIG. 5. In the above-described second aspect, the interpolation unit 3126 obtains the compensation level Cmp by internally dividing the two read compensation levels by the level of the image signal VID which is between the two points. In the above-described third aspect, the interpolation unit 3126 multiples (Cmp5–Cmp4)/(Vg5–Vg4), which indicates the slope in FIG. 5, by the difference obtained by subtracting the gray level Vg5 from the level of the image signal VID, and the interpolation unit 3126 adds the product to the read compensation level Cmp5 and outputs the sum as the compensation level Cmp. In other words, in the above-described third aspect, the interpolation unit 3126 obtains the compensation level Cmp which corresponds to the image signal VID as a point on an extension of the straight line between point c and point d towards the black end in FIG. 5.

In FIG. 4(*a*), the selector 316 selects one of input ports A and B in response to a signal PS, which indicates whether a compensated image signal VID' for positive writing or for negative writing should be supplied. More specifically, if the compensated image signal VID' for positive writing should be supplied, the selector 316 selects the compensation level Cmp at the input port A. If the image signal VID' for negative writing should be supplied, the selector 316 selects a zero value at the input port B.

The adder 318 adds the value selected by the selector 316 to the original image signal VID, and outputs the sum as the compensated image signal VID'. If the compensated image signal VID' should be supplied in accordance with positive writing, the compensated image signal VID' is a value obtained by adding the compensation level Cmp to the original image signal VID. If the compensated image signal VID' should be supplied in accordance with negative writing, the compensated image signal VID' is equal to the original image signal VID.

In the table 3122, the compensation levels Cmp1 to Cmp5, which are stored in association with the gray levels Vg1 to Vg5 of the image signal VID, are determined in the following manner. Specifically, the counter electrode 108 is set at a constant potential, and the image signal VID at the particular gray level Vg1 is supplied to the processing circuit 400, without taking into consideration the compensation level Cmp (or the compensation level Cmp is set to a provisional value). Accordingly, positive writing and negative writing are alternately performed. In this state, as shown in FIG. 6(*a*), effective voltages applied to the liquid crystal capacitor differ between positive writing and negative writing. As a result, a gray level difference is detected, and flickering occurs. The compensation level Cmp1 is actually increased or decreased to minimize the amount of flickering.

The least amount of flickering occurs if the gray level in positive writing and the gray level in negative writing are approximately the same, that is, if the effective voltages applied to the liquid crystal capacitor in positive writing and in negative writing are approximately the same. In the table 3122, the compensation level Cmp1, which is adjusted to minimize the amount of flickering generated, is finally set as the compensation level which corresponds to the gray level Vg1. In actual positive writing, the compensation level Cmp1 is added to the image signal VID at the gray level Vg1, and a voltage that corresponds to the sum is applied to the pixel electrode 118. Thus, the effective voltage in positive writing is approximately the same as the effective voltage when a voltage which corresponds to image signal VID at the gray level Vg1 is applied to the pixel electrode 118 in negative writing. In a similar manner, the compensation levels Cmp2 to Cmp5 which correspond to the gray levels Vg2 to Vg5 of the image signal VID are subjected to processing.

If the image signal VID corresponds to any one of the gray levels Vg1 to Vg5, the compensation level Cmp output from the image signal compensation circuit 300 arranged, as described above, is the compensation level read from the table 3122. In the second case in which the image signal VID is within the range A of the gray levels Vg1 to Vg5 and does not correspond to any of the five gray levels, the compensation level Cmp is obtained by interpolating the stored compensation levels. In the first aspect in which the image signal VID is towards the white end compared with the gray level Vg1, or in the third aspect in which the image signal VID is towards the black end compared with the gray level Vg5, the compensation level Cmp is obtained by the extension from the gray region.

In this embodiment, the appropriate compensation level Cmp is obtained for the whole range of gray levels of the image signal VID, and the compensation level Cmp is added to the image signal VID which corresponds to positive writing. Thus, at each gray level, the effective voltages applied to the liquid crystal capacitor are approximately the same at both polarities. For example, as shown in FIG. 6(*b*), an insufficient portion with respect to the effective voltage when the voltage Vnp is applied to the pixel electrode 118 in negative writing is added to the voltage Vgp as the compensation level Cmp in positive writing. Thus, the effective voltages applied to the liquid crystal capacitor are approximately the same at both polarities. As a result, application of a DC component to the liquid crystal is prevented, and burn-in is suppressed.

In this embodiment, only the compensation levels Cmp1 to Cmp5, which correspond to the five gray levels Vg1 to Vg5, are stored, and compensation levels, which correspond to other levels, are obtained by interpolation or by assuming that the compensation levels are on the extension. Thus, the storage capacity required for the table 3122 is very small. The compensation levels are not limited by the storage capacity to the compensation levels which correspond to the five gray levels.

In this embodiment, it is ideal to obtain compensation levels which correspond to gray levels other than the gray levels Vg1 to Vg5, such as a black level Vbk and a white level Vwt. However, in the liquid crystal display, a gray level (transmissivity) characteristic with respect to an effective voltage applied to the liquid crystal capacitor is such that the gray level greatly varies in response to a small change in the effective voltage in a gray region which corresponds to the intermediate region between black and white. In contrast, in a black region or a white region, the gray level hardly varies, even if the effective voltage greatly varies. It is thus difficult to adjust the black level Vbk and the white level Vwt (including neighboring levels) to minimize the amount of flickering generated. If it were possible to adjust the black level Vbk and the white level Vwt, it is very doubtful that the effective voltages applied to the liquid crystal capacitor at the positive polarity and the negative polarity are made to be approximately the same by the compensation.

In this embodiment, the compensation levels are only determined at different levels in the gray region. Compensation levels in the white region and the black region other than the gray region are computed by the extension from the gray region. Instead of computing compensation levels, which correspond to the white region and the black region using the extension, various methods, such as extrapolation from the gray region or n-degree interpolation, can be used.

Besides the foregoing method for determining the compensation levels stored in the table 3122, various other methods can be used. For example, the following method can be used. First, the image signal VID at a particular gray level is supplied to the processing circuit 400 without taking into consideration a compensation level, and positive writing and negative writing are alternately performed. Second, the potential LCcom of the counter electrode 108 is adjusted so as to minimize flickering (see FIG. 6(*c*)). Third, based on a variation ΔV caused by the adjustment, a compensation level for positive writing is determined.

Alternatively, first, the potential LCcom of the counter electrode 108 is maintained at a constant potential. After the polarity inversion, an image signal voltage in positive writing and an image signal voltage in negative writing are shifted in the opposite directions so that they have the same displacement, and a point at which the least amount of flickering is generated is obtained. Second, based on the displacement up to this point, a compensation level for positive writing is determined.

In FIG. 4(*a*), although the processing time, starting from the compensation-level output unit 312 to the adder 316, is ideally zero, it actually takes a predetermined amount of time. Thus, a delay unit that matches the timing with the compensation level Cmp is provided at a stage prior to inputting the uncompensated image signal VID to the adder 318. The same applies to the structure shown in FIG. 4(*b*). A delay unit that matches the timing with the compensation level read from the table 3122 is provided at a stage prior to inputting the uncompensated image signal VID to the interpolation unit 3126.

Operation of Liquid Crystal Display

The operation of the liquid crystal display arranged as described above is described. The transfer start pulse DY is supplied to the scanning-line driving circuit 130 at the beginning of a vertical scanning period. As shown in FIG. 7, the transfer start pulse DY is sequentially shifted every time the level of the clock signal CLY changes, and the transfer start pulse DY is output as signals G1', G2', G3', . . . , Gm'. From among the signals G1', G2', G3', . . . , Gm', the AND signal of the adjacent signals is obtained, and the obtained signals are output to the corresponding scanning lines 112 as scanning signals G1, G2, G3, . . . , Gm, which each become the ON-state potential every horizontal scanning period 1H.

The horizontal scanning period 1H in which the scanning signal G1 becomes the ON-state potential will now be described. In order to simplify the description, positive writing is performed in the horizontal scanning period 1H. The polarity inverter circuit 406 (see FIG. 1) outputs the image signals VID1 to VID6 at a higher potential than the constant potential Vc.

As shown in FIG. 7, the transfer start pulse DX is supplied to the data-line driving circuit 140 at the beginning of the horizontal scanning period. The transfer start pulse DX is output as signals S1', S2', S3', . . . , Sn', which are obtained by sequentially shifting the transfer start pulse DX every time the level of the clock signal CLX changes. The pulse duration of each of the signals S1', S2', S3', . . . , Sn' is narrowed to the period SMPa so that the adjacent signals do not overlap each other. Hence, the signals are output as sampling signals S1, S2, S3, . . . , Sn.

For positive writing, concerning the image signal VID input to the image signal compensation circuit 300, the corresponding compensation level Cmp is added. For negative writing, nothing is added. In each case, the result is output as the compensated image signal VID' every dot clock DCLK.

First, the compensated image signal VID' is converted by the D/A converter circuit 402 into an analog signal. Second, the analog signal is divided by the S/P converter circuit 404 into image signals VID1 to VID6, which are also temporally expanded sixfold. Third, the polarity of each of the image signals VID1 to VID6 is not inverted by the polarity inverter circuit 406, and the image signals VID1 to VID6 are supplied to the liquid crystal panel 100.

In a period in which the scanning signal G1 becomes the ON-state potential, when the sampling signal S1 becomes the ON-state potential, the image signals VID1 to VID6 are sampled with respect to the six data lines 114 which belong to the first block from the left. The sampled image signals VID1 to VID6 are supplied to the corresponding pixel electrodes 118 by the TFTs 116 of the pixels at the intersections between the first scanning line 112 from the top in FIG. 3 and the foregoing six data lines 114.

Subsequently, when the sampling signal S2 becomes the ON-state potential, the image signals VID1 to VID6 are sampled with respect to the six data lines 114 which belong to the second block. The image signals VID1 to VID6 are supplied to the corresponding pixel electrodes 118 by the TFTs 116 of the pixels at the intersections of the first scanning line 112 and the foregoing six data lines 114.

In a similar manner, when the sampling signals S3, S4, . . . , Sn sequentially become the ON-state potential, the image signals VID1 to VID6 are sampled with respect to the six data lines 114 which belong to the third, fourth . . . , n-th blocks. The image signals VID1 to VID6 are supplied to the corresponding pixel electrodes 118 by the TFTs 116 of the pixels at the intersections of the first scanning line 116 and the six data lines 114. Accordingly, writing to all the pixels belonging to the first row is completed.

A period in which the scanning signal G2 becomes the ON-state potential will now be described. In this embodiment, as described above, the polarity inversion is performed in scanning line units. In a horizontal scanning period, negative writing is performed. The polarity inverter circuit 406 outputs the image signals VID1 to VID6 at a lower potential than the constant potential Vc. The other operation is the same. The sampling signals S1, S2, S3, . . . , Sn sequentially become the ON-state potential, and writing to all the pixels, which belong to the second row, is completed.

In a similar manner, the scanning signals G3, G4, . . . , Gm become the ON-state potential every horizontal scanning period 1H, and writing to all the pixels which belong to the third, fourth, . . . , m-th rows is performed. Accordingly, positive writing is performed for the pixels belonging to the odd-numbered rows, whereas negative writing is performed for the pixels belonging to the even-numbered rows. In one vertical scanning period, writing to all the pixels belonging to the first to m-th rows is completed.

In the next vertical scanning period, similar writing is performed. The polarity of writing to the pixels belonging to each row is switched. In other words, in the next vertical scanning period, negative writing is performed for the pixels belonging to the odd-numbered rows, whereas positive writing is performed for the pixels belonging to the even-numbered rows. Accordingly, in this embodiment, the polarity of writing to the pixels is switched every vertical scanning period, and the appropriate compensation level Cmp is added to the image signal in positive writing. Thus, the effective voltage in positive writing and the effective voltage in negative writing are approximately the same. As a result, application of a DC component to the liquid crystal 105 is prevented, and the burn-in is avoided.

In such driving, the time required to sample the image signals by the sampling switches 151 is six times the time required by a system that drives the data lines 114 one at a time. Thus, the charging/discharging time in each pixel is reliably obtained, thereby obtaining a high contrast. The number of stages of the shift register in the data-line driving circuit 140 and the frequency of the clock signal CLX are both reduced to one sixth. In accordance with the reduction of the number of stages, the power consumption is also reduced.

Since the period in which the sampling signals S1, S2, . . . , Sn become the ON-state potential is narrowed to the period SMPa, which is less than the half period of the clock signal CLX, the adjacent sampling signals are prevented beforehand from overlapping with each other. The image signals VID1 to VID6, which are to be sampled with respect to the six data lines 114, which belong to a particular block, are prevented from simultaneously being sampled with respect to the six data lines 114, which belong to a block adjacent to the previous block. As a result, high-quality display can be performed.

Other Embodiments

In the foregoing embodiment, six data lines 114 are grouped into one block, and the converted image signals VID1 to VID6 for six lines are sampled with respect to the six data lines 114 which belong to one block. The conversion number and the number of data lines, to which the signals are simultaneously applied (that is, the number of data lines forming one block), are not limited to "6". For example, if the response speed of each sampling switch 151 in the sampling circuit 150 is sufficiently high, the compensated image signal is not necessarily subjected to parallel conversion; rather, the compensated image signal is serially transmitted to one image signal line and is sequentially sampled with respect to each data line 114. Alternatively, the conversion number and the number of data lines, to which the image signals are simultaneously supplied, can be "3", "12", or "24", and the compensated image signal, which is converted to three lines, twelve lines, or 24 lines, can be supplied to three data lines, twelve data lines, or 24 data lines. Concerning the conversion number, since a color image signal is formed of a signal for the three primary colors, it is preferable that the conversion number be a multiple of three with a view to simplifying the control and the circuit. If the present invention is simply used to modulate light as in a projector (described below), the conversion number is not necessarily a multiple of three.

In the above embodiment, the image signal compensation circuit 300 processes the digital image signal VID. Alternatively, the image signal compensation circuit 300 can process an analog image signal. In this case, the voltage of the image signal indicates the gray level of a pixel. In this embodiment, compensation is performed by the image signal compensation circuit 300 prior to serial-parallel conversion of the image signal. Alternatively, compensation can be performed subsequent to serial-parallel conversion. Alternatively, serial-parallel conversion is not necessarily performed.

In this embodiment, the compensation level Cmp is added to the image signal VID, which corresponds to positive writing, and the image signal, which corresponds to negative writing, is not compensated. In contrast, a compensation level Cmn is added to the image signal VID, which corresponds to negative writing, and the image signal, which corresponds to positive writing, is not compensated. When a compensation level is added to the image signal, which corresponds to negative writing, a characteristic is completely different from that shown in FIG. 5. The compensation level itself has a negative value.

Instead of adding a compensation level to the image signal, which corresponds to one-polarity writing, as shown in FIG. 8, it is possible to add the appropriate compensation levels Cmp and Cmn, which correspond to the respective levels to the image signal, which corresponds to positive writing, and the image signal, which corresponds to negative writing, respectively. In this case, when the image signal corresponds to positive writing, a selector 311 supplies the original image signal VID to a positive-polarity compensation-level output unit 312, and the compensation level Cmp is selected by a selector 316. In contrast, when the image signal corresponds to negative writing, the selector 311 supplies the original image signal VID to a negative-polarity compensation-level output unit 313, and the compensation level Cmn is selected by the selector 316.

In this embodiment, the liquid crystal display operates in a normally white mode, in which white is displayed, when the effective voltage applied to the liquid crystal capacitor is zero. Alternatively, the liquid crystal display can operate in a normally black mode in which black is displayed when the effective voltage applied to the liquid crystal capacitor is zero.

In this embodiment, a glass substrate is used as the device substrate 101. Alternatively, the technology of SOI (Silicon On Insulator) can be applied to form a silicon monocrystal film on an insulating substrate formed of sapphire, quartz, or glass, and various devices can be fabricated on the insulating substrate. Alternatively, a silicon substrate or the like can be used as the device substrate 101, and various devices can be formed on the silicon substrate. In such cases, field effect transistors can be used as various switches, and hence the high-speed operation becomes easy. If the device substrate 101 is not transparent, it is necessary to use the liquid crystal display as a reflective type by forming the pixel electrodes 118 of aluminum or by forming an additional reflecting layer.

Although the TN-type liquid crystal is used in this embodiment, a bistable type, such as a BTN (Bistable Twisted Nematic) type or a ferroelectric type having memory effects, a macromolecular dispersed type, or a GH (guest-host) type, can be used instead. In the GH type, a dye (guest) which exhibits anisotropy in visible light absorption between the long axis direction and the short axis direction of the molecules is dissolved in a liquid crystal (host) whose molecules are aligned in a certain direction, the dye molecules being oriented parallel to the liquid crystal molecules.

Alternatively, a homeotropic alignment structure can be used. In the homeotropic alignment structure, with no voltage applied, the liquid crystal molecules are oriented perpendicular to both substrates, and, when a voltage is applied, the liquid crystal molecules are oriented parallel to both substrates. Also, a homogeneous alignment structure can instead be used. In the homogeneous alignment structure, with no voltage applied, the liquid crystal molecules are oriented parallel to both substrates, and, when a voltage is applied, the liquid crystal molecules are oriented perpendicular to both substrates. According to the present invention, various types of liquid crystal and alignment modes can be used.

Electronic Apparatuses

A few electronic apparatuses, which each use the liquid crystal display of the above embodiment, will now be described.

(1) Projector

A projector, which uses the foregoing liquid crystal display as a light valve, is described. FIG. 9 is a plan view of the structure of such a projector. As shown in FIG. 9, a lamp unit 2102 formed by a white light source, such as a halogen lamp, is provided in a projector 2100. Incident light emitted from the lamp unit 2102 is separated into the primary colors R (red), G (green), and B (blue) by three mirrors 2106 and two dichroic mirrors 2108, which are arranged in the projector 2100, and the separated light rays enter light valves 100R, 100B, and 100G respectively, which correspond to the primary colors. Since the optical path of the blue light beam B, is longer than that of the red light beam R or the green light beam G, the blue light beam B is led through a relay lens system 2121 formed by an incident lens 2122, a relay lens 2123, and an outgoing lens 2124.

The structure of each of the light valves 100R, 100G, and 100B is similar to that of the liquid crystal panel 100 of the foregoing embodiment. The light valves 100R, 100G and 100B are driven by image signals, respectively, which correspond to R, G and B, and which are supplied from a processing circuit (not shown in FIG. 9). In the projector 2100, concerning the liquid crystal display shown in FIG. 1, three liquid crystal displays which correspond to the R, G, and B light beams, respectively, are formed.

The light beams modulated by the light valves 100R, 100G, and 100B enter a dichroic prism 2112 from three directions. In the dichroic prism 2112, the R and B light beams are refracted 90 degrees, while the G light beam travels straight. After images in these colors are combined, a color image is projected onto a screen 2120 by a projection lens 2114.

Since the light beams, which correspond to the primary colors R, G, and B, enter the light valves 100R, 100G, and 100B through the dichroic mirror 2108, as described above, it is unnecessary to provide color filters. Images transmitted through the light valves 100R and 100B are reflected by the dichroic prism 2112 and are projected. In contrast, an image transmitted through the light valve 100G is directly projected. Thus, the direction of horizontal scanning performed by the light valves 100R and 100B is the opposite of the direction of horizontal scanning performed by the light valve 100G, and an image in which right and left are inverted is displayed.

(2) Mobile Computer

An example in which the above-described liquid crystal display is applied to a mobile personal computer will now be described. FIG. 10 is a perspective view of the structure of such a personal computer. In FIG. 10, a computer 2200 includes a main unit 2204, including a keyboard 2202, and the liquid crystal panel 100 which is used as a display device. On the back side of the liquid crystal panel 100, a backlight unit (not shown in FIG. 10) that enhances the visibility is provided.

(3) Cellular Phone

An example in which the above-described liquid crystal display is applied to a cellular phone is described. FIG. 11 is a perspective view of the structure of such a cellular phone. In FIG. 11, a cellular phone 2300 includes a plurality of operation buttons 2302, an earpiece 2304, a mouthpiece 2306, and the liquid crystal panel 100 which is used as a display device. On the back side of the liquid crystal panel 100, a backlight unit (not shown in the drawing) that enhances the visibility is provided.

Summary of Electronic Apparatuses

The invention also covers electronic apparatuses other than those described with reference to FIGS. 9, 10, and 11. These examples include a television, a viewfinder-type or a monitor-direct-viewing-type video cassette recorder, a car navigation system, a pager, an electronic notebook, an electronic calculator, a word processor, a workstation, a video phone, a POS terminal, a digital still camera, and a device with a touch panel. Needless to say, the liquid crystal display of the present invention is applicable to these various types of electronic apparatuses as well as other and later developed electronic apparatuses.

As described above, according to the present invention, the effects of push-down and light leakage are added in advance to an image signal. In conclusion, the effective voltages finally applied to a liquid crystal capacitor at the positive polarity and the negative polarity are approximately equal to each other. As a result, the burn-in can be prevented.

What is claimed is:

1. An image signal compensation circuit for a liquid crystal display, the liquid crystal display including a plurality of scanning lines, a plurality of data lines, and pixels which correspond to intersections between the scanning lines and the data lines, each of the pixels comprised of a pixel electrode and opposing electrode between which liquid crystal sandwiched to form a liquid crystal capacitor, and a switching element which establishes a connection between a corresponding data line and the pixel electrode in accordance with a level of a signal supplied to a corresponding scanning line, the liquid crystal display inverting the polarity of an image signal, which is in synchronization with horizontal scanning and vertical scanning, every predetermined period on the basis of a predetermined potential and supplying the image signal to the pixel electrode through the data line, said image signal compensation circuit for compensating for the image signal for the liquid crystal display comprising:

a compensation-level output unit outputting the compensation level which corresponds to only the level of the image signal at one polarity; and an adder that adds the compensation level to the uncompensated image signal and outputs a sum as a compensated image signal, said compensation-level output unit outputting approximately zero as the compensation level which corresponds to the level of the image signal at the other polarity.

2. The image signal compensation circuit for a liquid crystal display according to claim 1, said compensation-level output unit outputting approximately zero as the compensation level which corresponds to the level of the image signal at the negative polarity.

3. An image signal compensation circuit for a liquid crystal display, the liquid crystal display including a plurality of scanning lines, a plurality of data lines, and pixels which correspond to intersections between the scanning lines and the data lines, each of the pixels comprised of a pixel electrode and opposing electrode between which liquid crystal sandwiched to form a liquid crystal capacitor, and a switching element which establishes a connection between a corresponding data line and the pixel electrode in accordance with a level of a signal supplied to a corresponding scanning line, the liquid crystal display inverting the polarity of an image signal, which is in synchronization with horizontal scanning and vertical scanning, every predetermined period on the basis of a predetermined potential and supplying the image signal to the pixel electrode through the data line, said image signal compensation circuit for compensating for the image signal for the liquid crystal display comprising:

a compensation-level output unit outputting the compensation level which corresponds to the level of the image signal at one polarity; and an adder that adds the compensation level to the uncompensated image signal and outputs a sum as a compensated image signal, said compensation-level output unit outputting the compensation level which corresponds to the level of the image signal at the other polarity.

4. An image signal compensation circuit for a liquid crystal display, the liquid crystal display including a plurality of scanning lines, a plurality of data lines, and pixels which correspond to intersections between the scanning lines and the data lines, each of the pixels comprised of a pixel electrode and opposing electrode between which liquid crystal is sandwiched to form a liquid crystal capacitor, and a switching element which establishes a connection between a corresponding data line and the pixel electrode in accordance with a level of a signal supplied to a corresponding scanning line, the liquid crystal display inverting the polarity of an image signal, which is in synchronization with horizontal scanning and vertical scanning, every predetermined period on the basis of a predetermined potential and supplying the image signal to the pixel electrode through the data line, said image signal compensation circuit for compensating for the image signal for the liquid crystal display comprising:

a compensation-level output unit including a table in which the relationship between the level of the uncompensated image signal and the compensation level is stored beforehand; and an adder that adds the compensation level to the uncompensated image signal and outputs a sum as a compensated image signal.

5. The image signal compensation circuit for a liquid crystal display according to claim 4:

said table storing the relationship at two or more points; and when the level of the uncompensated image signal is within the range of the stored relationship, said table interpolating and outputting the compensation level which corresponds to the level of the uncompensated image signal based on the stored relationship.

6. The image signal compensation circuit for a liquid crystal display according to claim 5, when the level of the uncompensated image signal is outside the range of the stored relationship, said table estimating and outputting the compensation level which corresponds to the level of the uncompensated image signal based on the stored relationship.

7. The image signal compensation circuit for a liquid crystal display according to claim 4, said table storing compensation levels based on a plurality of levels in a gray region.

8. The image signal compensation circuit for a liquid crystal display according to claim 4, said table storing a compensation level based on adjustment of a potential of the counter electrode at which the least amount of flickering occurs.

9. The image signal compensation circuit for a liquid crystal display according to claim 4, said table storing a compensation level based on the displacement in the level of the image signal at one polarity and the displacement of the level of the image signal at the other polarity at which the least amount of flickering occurs.

10. An image signal compensation circuit for a liquid crystal display, the liquid crystal display including a plurality of scanning lines, a plurality of data lines, and pixels which correspond to intersections between the scanning lines and the data lines, each of the pixels comprised of a pixel electrode and opposing electrode between which liquid crystal sandwiched to form a liquid crystal capacitor, and a switching element which establishes a connection between a corresponding data line and the pixel electrode in accordance with a level of a signal supplied to a corresponding scanning line, the liquid crystal display inverting the polarity of an image signal, which is in synchronization with horizontal scanning and vertical scanning, every predetermined period on the basis of a predetermined potential and supplying the image signal to the pixel electrode through the data line, said image signal compensation circuit for compensating for the image signal for the liquid crystal display comprising:

a compensation-level output unit that outputs a compensation level which corresponds to the level of the uncompensated image signal;

an adder that adds the compensation level to the uncompensated image signal and outputs a sum as a compensated image signal; and a delay unit that delays the uncompensated image signal and that matches timing with the compensation level output from said compensation-level output unit, said delay unit being provided at a stage prior to said adder.

11. An image signal compensation method for a liquid crystal display, the liquid crystal display including pixels corresponding to intersections between a plurality of scanning lines and a plurality of data lines, each of the pixels comprised of a pixel electrode and opposing electrode between which liquid crystal is sandwiched to form a liquid crystal capacitor, and a switching element which establishes a connection between a corresponding data line and the pixel electrode in accordance with a level of a signal supplied to a corresponding scanning line, the liquid crystal display inverting the polarity of an image signal, which is in synchronization with horizontal scanning and vertical scanning, every predetermined period on the basis of a predetermined potential and supplying the image signal to the pixel electrode the data line, said image signal compensation method for compensating for the image signal for the liquid crystal display comprising the steps of:

storing a table including the relationship between the level of the uncompensated image signal and the compensation level;

outputting a compensation level which corresponds to a level of the uncompensated image signal;

adding the compensation level to the uncompensated image signal; and outputting a sum as the compensated image signal.

12. An image signal compensation method for a liquid crystal display, the liquid crystal display including pixels corresponding to intersections between a plurality of scanning lines and a plurality of data lines, each of the pixels comprised of a pixel electrode and opposing electrode between which liquid crystal is sandwiched to form a liquid crystal capacitor, and a switching element which establishes a connection between a corresponding data line and the pixel electrode in accordance with a level of a signal supplied to a corresponding scanning line, the liquid crystal display inverting the polarity of an image signal, which is in synchronization with horizontal scanning and vertical scanning, every predetermined period on the basis of a predetermined potential and supplying the image signal to the pixel electrode through the data line, said image signal compensation method for compensating for the image signal for the liquid crystal display comprising the steps of:

outputting a compensation level which corresponds to a level of the uncompensated image signal:

adding the compensation level to the uncompensated image signal:

outputting a sum as the compensated image signal; and the outputting step including outputting a compensation level which corresponds to an image signal at a particular level is a value adjusted so that a gray level difference between a case in which the compensation level is added to the original image signal and the sum is applied to the pixel electrode and a case in which an image signal at the other polarity is applied to the pixel electrode becomes small.

13. A liquid crystal display, comprising:

a plurality of scanning lines;

a plurality of data lines;

pixels corresponding to intersections between the plurality of scanning lines and the plurality of data lines, each of the pixels comprised of a pixel electrode and opposing electrode between which liquid crystal is sandwiched to form a liquid crystal capacitor, and a switching element which establishes a connection between a corresponding data line and the pixel electrode in accordance with a level of a signal supplied to the scanning line; and an image signal compensation circuit that compensates for an image signal which is in synchronization with horizontal scanning and vertical scanning before the polarity of the image signal is inverted every predetermined period on the basis of a predetermined potential and the image signal is supplied to the pixel electrode through the data line, said image signal compensation circuit including a compensation-level output unit that includes a table in which the relationship between the level of uncompensated image signal and the compensation level is stored beforehand, and that outputs a compensation level which corresponds to the level of the uncompensated image signal, and an adder that adds the compensation level to the uncompensated image signal and outputs the sum as the compensated image signal.

14. An electronic apparatus, comprising:

the liquid crystal display as set forth in claim 13, the liquid crystal display being utilized as a display device.

15. The image signal compensation circuit for a liquid crystal display according to claim 4, said compensation-level output unit outputting approximately zero as the compensation level which corresponds to the level of the image signal at the other polarity.

16. The image signal compensation circuit for a liquid crystal display according to claim 10, said compensation-level output unit outputting approximately zero as the compensation level which corresponds to the level of the image signal at the other polarity.

17. The image signal compensation method of claim 11, said outputting step further outputting approximately zero as the compensation level which corresponds to the level of the image signal at the other polarity.

18. The liquid crystal display of claim 13, said compensation-level output unit outputting approximately zero as the compensation level which corresponds to the level of the image signal at the other polarity.

19. The image signal compensation circuit for a liquid crystal display of claim 3, wherein the compensation-level output unit includes a table in which the relationship between the level of the uncompensated image signal and the compensation level is stored beforehand.

20. The image signal compensation circuit for a liquid crystal display according to claim 19, said table storing the relationship at two or more points, and when the level of the uncompensated image signal is within the range of the stored relationship, said table interpolating and outputting the compensation level which corresponds to the level of the uncompensated image signal based on the stored relationship.

21. The image signal compensation method of claim 11, further comprising:

storing the relationship at two or more points; and interpolating and outputting the compensation level which corresponds to the level of the uncompensated image signal based on the stored relationship, when the level of the uncompensated image signal is within the range of the stored relationship.

22. The liquid crystal display of claim 13, wherein said relationship is stored at two or more points, and said table interpolates and outputs the compensation level which corresponds to the level of the uncompensated image signal based on the stored relationship, when the level of the uncompensated image signal is within the range of the stored relationship.

* * * * *